US011549287B2

(12) United States Patent
Brown et al.

(10) Patent No.: US 11,549,287 B2
(45) Date of Patent: Jan. 10, 2023

(54) DOOR LATCH, IN PARTICULAR MOTOR VEHICLE DOOR LATCH

(71) Applicant: Kiekert AG, Heiligenhaus (DE)

(72) Inventors: Scott Brown, Livonia, MI (US); Paolo Dozio, Varese (IT); Ralph Bernasconi, Melano (CH)

(73) Assignee: Kiekert AG, Heiligenhaus (DE)

( * ) Notice: Subject to any disclaimer, the term of this patent is extended or adjusted under 35 U.S.C. 154(b) by 364 days.

(21) Appl. No.: 16/702,640

(22) Filed: Dec. 4, 2019

(65) Prior Publication Data

US 2021/0172210 A1 Jun. 10, 2021

(51) Int. Cl.

| | |
|---|---|
| ***E05B 81/14*** | (2014.01) |
| ***E05B 81/06*** | (2014.01) |
| ***E05B 81/66*** | (2014.01) |
| ***G04F 3/00*** | (2006.01) |
| ***E05B 81/16*** | (2014.01) |
| ***E05B 77/30*** | (2014.01) |
| ***E05B 81/68*** | (2014.01) |
| *E05B 79/20* | (2014.01) |
| *E05B 77/48* | (2014.01) |

(52) U.S. Cl.

CPC ..... *E05B 81/14* (2013.01); *E05B 81/06* (2013.01); *E05B 81/66* (2013.01); *E05B 81/68* (2013.01); *G04F 3/00* (2013.01); *E05B 77/30* (2013.01); *E05B 77/48* (2013.01); *E05B 79/20* (2013.01); *E05B 81/16* (2013.01)

(58) Field of Classification Search

CPC ..... E05B 81/14; E05B 81/06; E05B 81/66; E05B 77/30; E05B 81/16; E05B 81/64; E05B 81/68; E05B 81/72; G04F 3/00

USPC ..... 702/176

See application file for complete search history.

(56) References Cited

U.S. PATENT DOCUMENTS

| | | | | |
|---|---|---|---|---|
| 4,197,524 | A * | 4/1980 | Salem | G07C 9/00658 340/5.51 |
| 4,425,597 | A * | 1/1984 | Schramm | G07C 9/00682 361/172 |
| 6,863,318 | B2 | 3/2005 | Mejean | |
| 7,135,787 | B2 * | 11/2006 | Alexandropoulos | G07C 9/0069 70/278.1 |
| 7,180,400 | B2 * | 2/2007 | Amagasa | E05B 81/78 340/5.72 |

(Continued)

FOREIGN PATENT DOCUMENTS

| | | | | |
|---|---|---|---|---|
| EP | 1350908 | A2 | 10/2003 | |
| FR | 2871830 | A1 * | 12/2005 | E05B 77/26 |
| WO | WO-2020228895 | A1 * | 11/2020 | E05B 77/12 |

*Primary Examiner* — Kristina R Fulton
*Assistant Examiner* — Emily G. Brown
(74) *Attorney, Agent, or Firm* — Renner, Otto, Boisselle & Sklar, LLP

(57) ABSTRACT

A door latch and in particular a motor vehicle door latch, which is equipped with a locking mechanism consisting substantially of a catch and a pawl, further having at least one locking mechanism sensor to determine the closing/opening state of the locking mechanism, further having a control unit for evaluating signals of the locking mechanism sensors, and having a trigger sensor for opening the locking mechanism in an electro-motoric manner. According to the invention, a multiple operation of the trigger sensor regardless of the state of the locking mechanism sensor is implemented for opening the locking mechanism.

13 Claims, 1 Drawing Sheet

(56) References Cited

U.S. PATENT DOCUMENTS

| | | | | |
|---|---|---|---|---|
| 9,845,623 | B1 * | 12/2017 | Gage | E05B 81/16 |
| 10,125,524 | B2 * | 11/2018 | Kouzuma | E05B 81/14 |
| 10,428,560 | B2 * | 10/2019 | Dente | E05B 81/76 |
| 10,544,607 | B2 * | 1/2020 | Lange | E05B 81/76 |
| 2003/0164616 | A1 * | 9/2003 | Belmond | E05B 77/30<br>292/201 |
| 2003/0182863 | A1 * | 10/2003 | Mejean | E05B 81/70<br>49/26 |
| 2003/0222759 | A1 * | 12/2003 | Amagasa | G07C 9/00309<br>340/5.72 |
| 2005/0218913 | A1 * | 10/2005 | Inaba | H03K 17/955<br>324/678 |
| 2008/0000711 | A1 * | 1/2008 | Spurr | E05B 77/30<br>180/289 |
| 2014/0285320 | A1 * | 9/2014 | Blackmer | B60R 25/20<br>340/5.72 |
| 2016/0017645 | A1 * | 1/2016 | Tomaszewski | E05B 81/90<br>292/240 |
| 2017/0362861 | A1 * | 12/2017 | Gage | E05B 81/72 |
| 2019/0017299 | A1 * | 1/2019 | Capalau | E05B 81/12 |

* cited by examiner

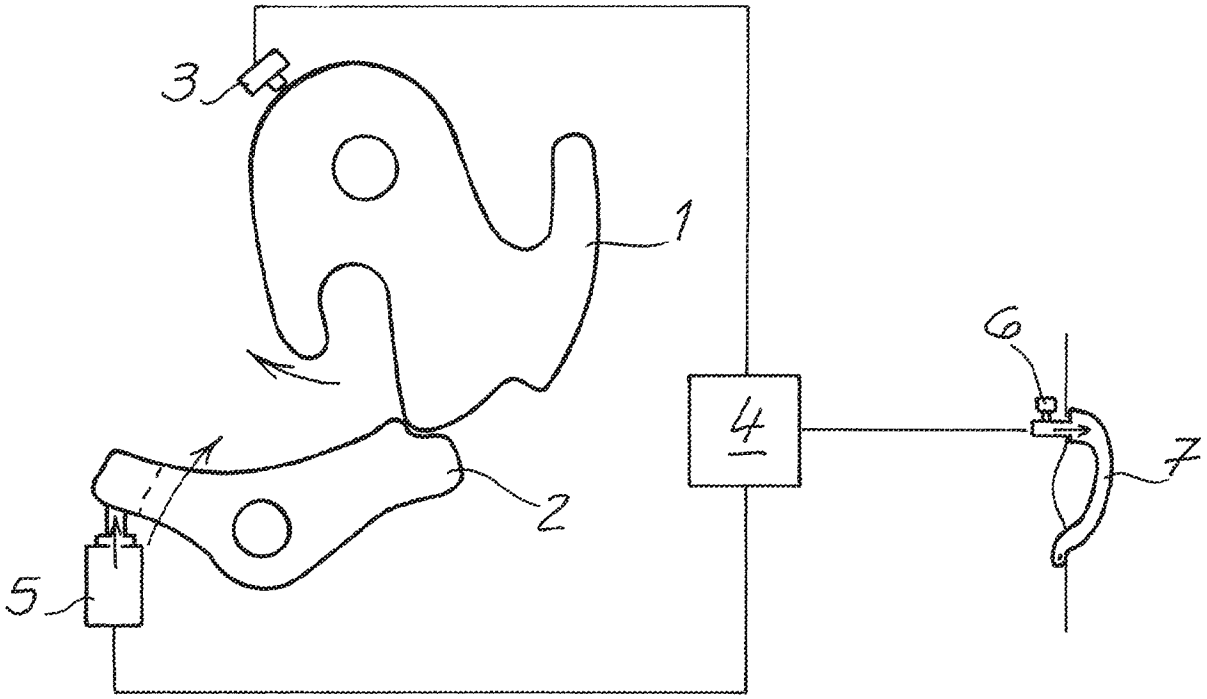
1
2
3
4
5
6
7

DOOR LATCH, IN PARTICULAR MOTOR VEHICLE DOOR LATCH

FIELD OF DISCLOSURE

The invention relates to a door latch, in particular a motor vehicle door latch, having a locking mechanism consisting substantially of a catch and a pawl, further having at least one locking mechanism sensor for determining the closing/opening state of the locking mechanism, further having a control unit for the evaluation of signals of the locking mechanism sensor, and having a trigger sensor for opening the locking mechanism in an electro-motoric manner.

BACKGROUND OF DISCLOSURE

The aforementioned door latch and in particular the motor vehicle door latch is a so-called electric latch. Such electric latches are increasingly used in practice because opening the locking mechanism consisting of a catch and a pawl occurs substantially in an electro-motoric manner, i.e. using an electromotor, if necessary having a downstream gearbox. As a result, such electric latches can be opened particularly easily, comfortably and quietly.

The generic state of the art according to EP 1 350 908 A2 concerns a control system for a motor vehicle door latch. Said latch has at least a sensor and an actuator or electromotor drive. A control logic is provided thereby. In fact, the possibility of operating an inner door handle multiple times with an associated trigger sensor is described, in order to be able to open an associated motor vehicle door. In this case, it is carried out in such a way that different functional states are derived from the multiple operation of the inner handle. First, a type of blocking mechanism is removed before the desired electrical opening is performed in a second operation. This is relatively complex. In addition, a locking mechanism sensor is additionally realized at this point, wherein with its help an incomplete closure of the locking mechanism is detected and displayed, i.e. signals of the locking mechanism sensor are included in the operation.

In another solution according to U.S. Pat. No. 6,863,318 B2, it switches to a mechanical operation in the event of a failure of the electrical opening mechanism. This requires additional mechanical operation elements including mostly flexible transmission elements, which increases the design and technological effort.

In principle, the state of the art according to EP 1 350 908 A2 has proven itself when it comes to the evaluation of signals of the trigger sensor as well as of those of the locking mechanism sensors. However, depending on the operation of the trigger sensor and its number, a distinction is made between different functional states. In practice, there may be misinterpretations by the control unit, for example, if the trigger sensor is triggered and operated in quick succession or not completely.

Similar problems arise in the event that the locking mechanism sensor does not emit a sensor signal or that it provides an incorrect sensor signal. For example, it is conceivable that the locking mechanism sensor communicates an open locking mechanism to the control unit, even though this does not correspond to the actual conditions. In this case, the operation of the trigger sensor is often ineffective, because the control unit generally suppresses an action upon the electromotor drive when the locking mechanism is open. The invention as a whole wants to remedy this situation.

SUMMARY OF DISCLOSURE

The invention is based on the technical problem, to further develop such a door latch and in particular such a motor vehicle door latch such that in particular an opening of the locking mechanism is possible even if individual sensor signals are not present or are not completely present or if false signals are observed.

To solve the technical problem in a generic door latch and in particular in a motor vehicle door latch, the invention proposes that a multiple operation of the trigger sensor regardless of the state of the locking mechanism sensor—is realized (from the unit) in order to open the locking mechanism.

According to the invention, therefore, the multiple operation of the trigger sensor is interpreted by the control unit in such a way that a malfunction of the locking mechanism sensor is present. This is because the simple operation of the trigger sensor with a functioning locking mechanism sensor usually results in the electromotor drive being controlled via the control unit for opening the locking mechanism. The opening of the locking mechanism then leads to the corresponding signal of the locking mechanism sensor, which reports the open locking mechanism to the control unit. This is the normal operation.

However, if there is now a disruption of the operation, for example, if the locking mechanism sensor reports the open locking mechanism to the control unit, although this is not the case at all, an operator will try to open the corresponding motor vehicle door anyway. This operator request usually occurs upon multiple operations of the trigger sensor. So far and in the state of the art, this multiple operation of the trigger sensor has been ignored by the control unit, at least until the locking mechanism sensor reports the signal "open" to the control unit. According to the invention, however, in a multiple operation of the trigger sensor, the state of the locking mechanism sensor is ignored by the control unit.

As a result, if the locking mechanism sensor malfunctions, the operator's request to open the locking mechanism and thus the associated motor vehicle door is realized. This does not result in an excessive load on the electromotor drive to open the locking mechanism. In addition, the noise behavior is optimized, because a multiple operation of the trigger sensor by the operator is realized directly into the desired opening of the locking mechanism without ignoring the signals of the trigger sensor or having to initiate other measures such as a mechanical opening process of the associated motor vehicle door.

The trigger sensor is usually provided on a handle, for example an external handle or an external door handle. Basically, the handle can also be an inner handle or an inner door handle. The locking mechanism sensor is usually a catch sensor, although the locking mechanism sensor may also be generally formed as a pawl sensor or both.

As a rule, however, the invention uses a catch sensor as a locking mechanism sensor, i.e. a sensor with which, in the concrete exemplary case, the opening position of the catch can be queried. The locking mechanism sensor is attached to the control unit. In addition, an electromotor drive is realized advantageously, which, depending on signals of the control unit, lifts off the pawl from the catch directly or indirectly. An indirect action upon the pawl by the electromotor drive is present, for example, in the event that between the electromotor drive and the pawl one or more levers are provided, for example a trigger lever, which is acted upon by the electromotor drive and then in turn acts upon the pawl such that it is lifted off from the catch. In the case of an immediate action upon the pawl by the electromotor drive, said drive works directly on the pawl. This can be done, for example, by a linear actor which is acted upon by the electromotor drive and connected to the pawl or by a rope provided between the electromotor drive and the pawl or also by other measures.

The multiple operation of the trigger sensor and the evaluation of the corresponding sensor signals by the control unit can be carried out in different ways within the scope of the invention. As a rule, the action is done in such a way that the multiple operation of the trigger sensor above a predetermined minimum number is implemented for opening the locking mechanism by the control unit. In this case, a minimum number for the operation number of the trigger sensor by the control unit is given and examined upon concrete action to see whether this minimum number has been exceeded or not. Only when the minimum number is exceeded, the multiple operation of the trigger sensor is implemented and leads to the action upon the electromotor drive for opening the locking mechanism.

In principle and in addition to the minimum number, a maximum number can also be evaluated during the multiple operation of the trigger sensor and incorporated into the action upon the electromotor drive. In most cases, a minimum number and a maximum number are set. The maximum operation number on the trigger sensor ensures that, for example, the trigger sensor or the handle supporting said trigger sensor are not damaged by excessive action. In any event, this inventive measure ensures that the operation number of the trigger sensor is determined and counted by the control unit and, in addition, it is checked to determine whether this operation number is located within an allowed window between the minimum number and the maximum number. For example, the minimum number may already be present upon two operations of the trigger sensor. The maximum operation number may be, for example, ten operations of the trigger sensor.

In addition, the invention also ensures a temporal classification of the operation of the trigger sensor. In fact, the multiple operation of the trigger sensor is implemented by the control unit within a given minimum time window and/or maximum time window for opening the locking mechanism. This alternative or additional requirement ensures that the trigger sensor is operated multiple times in a permissible time window. For example, the minimum time window may belong to one second and the maximum time window to ten seconds. This is, of course, only exemplary and is by no means restrictive.

In addition, it has proven itself when a time-dependent operation number of the trigger sensor is determined by the control unit. This time-dependent operation number of the trigger sensor expresses how many operations of the trigger sensor have taken place within a given time interval, for example, one operation per second, two operations per second, etc. This makes it possible to determine a window for a permissible operation number of the trigger sensors. For example, this window for allowed operations may range from one operation per second to five operations per second.

All these specifications are stored in the control unit and are evaluated during the action upon the trigger sensor and checked for compliance. As soon as the operation of the trigger sensor is located within one or more predetermined windows, this is interpreted by the control unit as a type of "emergency operation" of the corresponding handle. This "emergency operation" is present in the event that the locking mechanism sensor incorrectly sends a signal to the control unit that the locking mechanism is open, although the locking mechanism is actually still in its closing position.

According to the invention, the signal of the locking mechanism sensor is now ignored in a multiple operation of the trigger sensor. This multiple operation of the trigger sensor is examined according to an advantageous design within the predetermined windows for the operation number, their duration and also the time-dependent operation number. If the operation is within one or more allowed windows, the signal of the locking mechanism sensor is ignored and, independent of the state of the locking mechanism sensors, the control unit emits a signal to the electromotor drive for opening the locking mechanism. These are the substantial advantages.

The object of the invention is also a method for operating such a motor vehicle door latch. As a result, a door latch and in particular a motor vehicle door latch is provided, which in a strikingly simple way also makes it possible to open an electromotor locking mechanism in case the locking mechanism sensor querying the state of the locking mechanism provides the wrong signal. Here, the invention is based on the realization that the (wrong) signal of the locking mechanism sensor can be ignored if the trigger sensor is repeatedly controlled by an operator, which indicates that the locking mechanism sensor is representing the actual state of the locking mechanism incorrectly.

The trigger sensor is usually assigned to a handle and in particular to an external handle and detects its operation. In principle, however, the trigger sensor can also be a component of a remote control for opening the door latch and in particular the motor vehicle door latch. In any case, a simple and functional solution is provided.

BRIEF DESCRIPTION OF DRAWINGS

In the following, the invention is explained in more detail by means of a drawing depicting only an exemplary embodiment; the sole FIG. 1 shows the door latch according to the invention in the form of a motor vehicle door latch schematically and in a manner reduced to the components substantial for the invention.

DETAILED DESCRIPTION

In FIG. 1, a door latch is shown. The door latch is not restrictively a motor vehicle door latch, i.e. a door latch, which is attached to or in an unspecified motor vehicle door. The door latch has in its basic structure a locking mechanism 1, 2 consisting substantially of the catch 1 and the pawl 2. Furthermore, at least one locking mechanism sensor 3 is realized for determining the closing/opening state of the locking mechanism 1, 2. The locking mechanism sensor 3 in the exemplary embodiment is a catch sensor 3, i.e. a sensor with the help of which, in particular, the opening state of the locking mechanism 1, 2 or the catch 1 can be detected and transmitted to a control unit 4 in the exemplary embodiment.

The control unit 4 is used for the evaluation of signals of the locking mechanism sensor or the catch sensor 3 according to the exemplary embodiment. In addition, with the help of the control unit 4, an electromotor drive 5 can be acted upon, which according to the exemplary embodiment acts directly or indirectly on the pawl 2. It can be seen that the electromotor drive 5 acts upon the pawl 2 with the help of the control unit 4 in the clockwise direction indicated in FIG. 1, such that the pawl 2 is lifted off from the catch 1. As a result of this, the catch 1 can pan clockwise and release a locking bolt previously caught and indicated in FIG. 1. In this process, the locking mechanism sensor or catch sensor 3 is acted upon and reports the signal "Locking mechanism 1, 2 or catch 3 open" to the control unit 4.

The locking mechanism 1, 2 is opened depending on signals of a trigger sensor 6. The trigger sensor 6 is assigned to a handle 7 according to the exemplary embodiment, in which it is in the exemplary embodiment an external handle or an external door handle. An action upon the external handle 7 in an opening sense ensures that the signal of the trigger sensor 6 is interpreted by the control unit 4, which evaluates the signals of the trigger sensor 6, in such a way that the electromotor drive 5 must be controlled for lifting off the pawl 2 from the catch 1. This is done depending on signals of the locking mechanism sensor or catch sensors 3.

If the locking mechanism sensor or catch sensor 3 reports the signal "Locking mechanism 1, 2 or catch 1 open" to the control unit 4, the control unit 4 ignores a one-time operation of the external handle 7 for the action upon the trigger sensor 6. However, if the trigger sensor 6 is operated multiple times with the help of the handle 7 in the exemplary embodiment and according to the invention, this multiple operation of the trigger sensor 6 ensures, regardless of the state of the locking mechanism sensor 3, that the locking mechanism 1, 2 is opened. To this end, the "emergency operation" which has already been mentioned above corresponds thereto.

For this purpose, the control unit 4 examines the operation of the trigger sensor 6 in order to determine whether a specified minimum number and a maximum number of the operation number of the trigger sensor 6 have been exceeded. For example, the minimum number may be two operations and the maximum number may be ten operations of the trigger sensor 6.

In addition, the control unit 4 examines the operation of the trigger sensor 6 in order to determine whether the multiple operation of the trigger sensor 6 occurred within a predetermined minimum time window and maximum time window. The minimum time window may correspond to one second and the maximum time window to ten seconds. Finally, the control unit 4 also examines the signal or signal sequence of the trigger sensor 6 in terms of how the time-dependent operation number designed. This means that the control unit 6 also evaluates the operation number of the trigger sensor 6 per unit of time, for example, one operation per second, two operations per second, etc.

In total, the control unit 4 gives a window for the operation number of the trigger sensor 6, a window for the time of the operation of the trigger sensor 6 and finally a window for a permissible operation number, for example from one operation per second to five operations per second. As soon as the operation of the trigger sensor 6 moves within the one or more windows, this is interpreted by the control unit 4 in the scope of the invention to the extent that "emergency operation" is desired by the operator. This is the case when the locking mechanism sensor or catch sensor 3 incorrectly reports the state "open" to the control unit 4, although the locking mechanism 1, 2 does not actually have its state "open." In this case, the multiple operation of the trigger sensor 6 with the help of the handle or external handle 7 in the exemplary embodiment and according to the invention ensures that the locking mechanism 1, 2 is opened with the help of the electromotor drive 5, regardless of the state of the locking mechanism sensor or of the catch sensor 3.

This means that the multiple operation of the trigger sensor 6 is evaluated in the scope of the invention in a time and/or number-dependent manner by the control unit 4. If specified limits are adhered to by the control unit 4 during this evaluation, the multiple operation of the trigger sensor 6 ensures that the electromotor opens the locking mechanism 1, 2, namely with the help of the electromotor drive 5.

REFERENCE LIST

1 Catch
2 Pawl
1, 2 Locking mechanism
3 Locking mechanism sensor/catch sensor
4 Control unit
5 Drive
6 Trigger sensor
7 Handle/external handle

The invention claimed is:

1. A door latch comprising:

a locking mechanism having a catch and a pawl;

at least one locking mechanism sensor configured to generate signals indicating a closing/opening state of the locking mechanism;

a trigger sensor for opening the locking mechanism, wherein the trigger sensor is configured to generate trigger signals indicating operation of a trigger handle;

a control unit for evaluating the signals of the at least one locking mechanism sensor and the trigger signals from the trigger sensor; and an electromotor drive which, directly or indirectly, lifts the pawl from the catch in dependence on the signals received by the control unit, wherein the control unit is further configured to ignore the signals of the at least one locking mechanism sensor and open the locking mechanism via the electromotor drive lifting the pawl after multiple operations of the trigger handle occur.

2. The door latch according to claim 1, wherein the control unit is configured to determine the multiple operations of the trigger handle based on a number of operations that is above a predetermined minimum number and/or below a predetermined maximum number.

3. The door latch according to claim 1, wherein the control unit is configured to determine the multiple operations of the trigger handle based on the multiple operations occurring within a predetermined time window, wherein the time window includes a minimum value and a maximum value.

4. The door latch according to claim 1, wherein the control unit is configured to determine a time-dependent operation number of the trigger handle.

5. The door latch according to claim 1, wherein the control unit is configured to specify a time window for a permissible operation number of the trigger handle.

6. The door latch according to claim 1, wherein the at least one locking mechanism sensor is formed as a catch sensor.

7. The door latch according to claim 5, wherein the control unit is configured to specify the time window as being between 1 second and 5 seconds.

8. The door latch according to claim 1, wherein the trigger handle is an external handle.

9. The door latch according to claim 1, wherein the control unit is configured to ignore a one-time operation of the trigger handle when the at least one locking mechanism sensor determines that the locking mechanism is in an open state, whereby the locking mechanism is not opened.

10. The door latch according to claim 1, wherein the control unit is configured to open the locking mechanism after multiple operations of the trigger handle occur when the locking mechanism is in an open state and when the locking mechanism is in a closed state.

11. The door latch according to claim 10, wherein the control unit is configured to open the locking mechanism after multiple operations of the trigger handle occur when the at least one locking mechanism sensor falsely detects that the locking mechanism is in the open state.

12. The door latch according to claim 3, wherein the control unit is configured to determine the multiple operations of the trigger handle based on the multiple operations occurring within the predetermined time window, wherein the minimum value corresponds to one second and the maximum value corresponds to ten seconds.

13. The door latch according to claim 2, wherein the control unit is configured to determine the multiple operations of the trigger handle based on the number of operations that is above the predetermined minimum number and below the predetermined maximum number, the predetermined minimum number being two or more and the predetermined maximum number being ten or less.

* * * * *